US012703972B2

(12) United States Patent
Connell et al.

(10) Patent No.: US 12,703,972 B2
(45) Date of Patent: Aug. 11, 2026

(54) METHOD AND APPARATUS FOR CONNECTING PRECAST CONCRETE ELEMENTS

(71) Applicant: Structural Connections IP Pty Ltd, Brisbane (AU)

(72) Inventors: Robert Urquhart Connell, Brisbane (AU); Ashley Daniel Pollard, Brisbane (AU); George Spiropoulos, Brisbane (AU)

(73) Assignee: Structural Connections IP Pty Ltd, Brisbane (AU)

( * ) Notice: Subject to any disclaimer, the term of this patent is extended or adjusted under 35 U.S.C. 154(b) by 611 days.

(21) Appl. No.: 17/789,032

(22) PCT Filed: Dec. 23, 2020

(86) PCT No.: PCT/AU2020/051425
§ 371 (c)(1),
(2) Date: Jun. 24, 2022

(87) PCT Pub. No.: WO2021/127739
PCT Pub. Date: Jul. 1, 2021

(65) Prior Publication Data

US 2023/0044480 A1 Feb. 9, 2023

(30) Foreign Application Priority Data

Dec. 24, 2019 (AU) ..... 2019904949

(51) Int. Cl.
*E04B 1/04* (2006.01)
*E04B 1/21* (2006.01)
(Continued)

(52) U.S. Cl.
CPC ..... *E04B 1/215* (2013.01); *E04B 1/043* (2013.01); *E04B 1/4121* (2013.01); *E04B 1/48* (2013.01);
(Continued)

(58) Field of Classification Search
CPC ..... E04B 1/6162
See application file for complete search history.

(56) References Cited

U.S. PATENT DOCUMENTS 3,562,979 A * 2/1971 Ali-Oglu ..... E04B 1/215 52/577
4,099,360 A * 7/1978 Outram ..... E04B 1/21 52/745.18
(Continued)

FOREIGN PATENT DOCUMENTS

CN 109267647 A 1/2019
CN 209129148 U 7/2019
(Continued)

OTHER PUBLICATIONS

International Search Report for International Application No. PCT/AU2020/051425, mailed Mar. 1, 2021, 3 pages.

*Primary Examiner* — Brian E Glessner
(74) *Attorney, Agent, or Firm* — Morgan, Lewis & Bockius LLP

(57) ABSTRACT

An apparatus for connecting precast elements, wherein the apparatus includes a first part adapted for being cast into a first one of the precast elements, and the apparatus further includes a second part adapted for being cast into a second one of the precast elements, wherein the first part and the second part are arranged to receive a fastener for fastening the second precast element relative to the first precast element with the fastener crossing a joint between the precast elements at an angle to the joint.

14 Claims, 7 Drawing Sheets

(51) Int. Cl.
*E04B 1/41* (2006.01)
*E04B 1/48* (2006.01)
*E04B 1/61* (2006.01)

(52) U.S. Cl.
CPC ..... *E04B 1/6116* (2013.01); *E04B 1/6162* (2013.01); *E04B 2001/4192* (2013.01); *E04B 2001/6195* (2013.01)

(56) References Cited

U.S. PATENT DOCUMENTS

| | | | | |
|---|---|---|---|---|
| 10,221,558 | B1 | 3/2019 | Silva et al. | |
| 2013/0031857 | A1 * | 2/2013 | Tincher | E04B 1/043 52/274 |

FOREIGN PATENT DOCUMENTS

| | | | | | |
|---|---|---|---|---|---|
| CN | 211037485 | U * | 7/2020 | | |
| DE | 102012223279 | A1 * | 6/2014 | | E04B 1/043 |
| EP | 3263795 | A1 | 1/2018 | | |
| JP | 2003261992 | A * | 9/2003 | | |
| SE | 367039 | B | 5/1974 | | |
| WO | WO-2016040694 | A1 * | 3/2016 | | E04C 1/40 |

* cited by examiner

METHOD AND APPARATUS FOR CONNECTING PRECAST CONCRETE ELEMENTS

FIELD OF THE INVENTION

The present invention relates to a method and apparatus for connecting precast elements and more specifically, but not exclusively, to a method and apparatus for connecting concrete elements. The elements may be in the form of concrete panels or other concrete components.

BACKGROUND TO THE INVENTION

There is a problem in that it is difficult to construct a multi-storey building with reduced costs while also improving structural integrity and the ability of the building to withstand high winds or other high loads such as earthquakes. The applicant has identified that it would be advantageous to have a method and apparatus for connecting precast concrete elements with improved robustness. Existing methods are typically expensive and are labour-intensive. An existing precast element connector and connection method is disclosed in International patent application No. PCT/AU2010/000875.

The applicant has identified that it would be advantageous to provide an apparatus and method which enables buildings to be constructed with improved cost-effectiveness, with improved efficiency, and with structural improvement to meet tightening building codes. Examples of the present invention seek to provide an alternative apparatus and method for coupling concrete elements to facilitate cost-effective and safe construction of buildings.

SUMMARY OF THE INVENTION

In accordance with one aspect of the present invention, there is provided an apparatus for connecting precast elements, wherein the apparatus includes a first part adapted for being cast into a first one of the precast elements, and the apparatus further includes a second part adapted for being cast into a second one of the precast elements, wherein the first part and the second part are arranged to receive a a fastener for fastening the second precast element relative to the first precast element wherein the fastener crosses a joint between the precast elements at an angle to the joint.

Preferably, a longitudinal axis of the fastener is located at a non-zero angle to a first normal axis normal to a joint edge surface of the first precast element and is also at a non-zero angle to a second normal axis normal to a joint edge surface of the second precast element.

In a preferred form, the first part and the second part are arranged to receive a pair of fasteners for fastening the second precast element relative to the first precast element, wherein each of the fasteners crosses a joint between the precast elements at an angle to the joint.

Preferably, the fasteners are spaced in a dimension parallel to a longitudinal axis of the joint. More preferably, the fasteners are spaced in a vertical dimension.

In one form, the fasteners are crossed in at least one dimension. More preferably, the fasteners are crossed in two mutually perpendicular dimensions.

Preferably, the fastener provides a direct connection between reinforcement in the first element and reinforcement in the second element. More preferably, the fastener provides a direct connection between rear reinforcement in the first element and front reinforcement in the second element. Even more preferably, one fastener provides a direct connection between rear reinforcement in the first element and front reinforcement in the second element, and the other fastener provides a direct connection between rear reinforcement in the second element and front reinforcement in the first element.

Preferably, each fastener extends in a respective plane, each of the respective planes being within plus or minus 10° of a horizontal plane.

Preferably, the first and second parts are arranged such that the fasteners are in a mutually crossed configuration.

Preferably, each part is adapted to be anchored relative to each of the first fastener and the second fastener, directly and/or by way of reinforcement of the precast elements.

In a preferred form, the first part is in the form of a first plate arranged for casting into an opposed edge of the first precast element and the second part is in the form of a second plate arranged for casting into an opposed edge of the second precast element. More preferably, the first plate has a sleeve for receiving a first one of the fasteners, and the second plate has a sleeve for receiving a second one of the fasteners. More preferably, both parts are the same. In particular, the first part and the second part may be formed as an identical common part.

Preferably, the plates are adapted to be arranged in a mutually parallel facing configuration, each of the sleeves extending outwardly from the respective plate at an angle so as to open toward an exposed side of the first and second precast elements. More preferably, each of the sleeves is arranged to open into a cavity formed in the respective precast element. Even more preferably, each of the sleeves has an outward bearing surface for bearing relative to a nut as the nut is tightened on the fastener extending through the sleeve. Once the precast elements are connected in this way, filler material is applied between the panels. The filler material surrounds the connectors and acts as a structural shear connection between the concrete elements. In this way, the filler material acts as a dowel so as to further secure the connection. The filler material may be in the form of grout filler with non-shrink high-strength fibre reinforcement. A seal may also be provided along a rear location of a gap between the elements for sealing between the elements and to prevent unwanted egress of the filler material. Recesses formed at a frontal exposed surface of the elements may also be filled with non-shrink grout to achieve fire rating requirements.

In accordance with another aspect of the present invention, there is provided a system for connecting precast elements, wherein the system includes a first part adapted for being cast into a first one of the precast elements and a second part adapted for being cast into a second one of the precast elements, the system further including a fastener, wherein the first part and the second part are arranged to receive the fastener for fastening the second precast element relative to the first precast element with the fastener crossing a joint between the precast elements at an angle to the joint.

In accordance with yet another aspect of the present invention, there is provided a connection system for concrete elements in combination with a pair of concrete elements, wherein the system includes a first part cast into a first one of the concrete elements and a second part cast into a second one of the concrete elements, the system further including a fastener, wherein the first part and the second part receive the fastener such that the fastener secures the second concrete element relative to the first concrete element with the fastener crossing a joint between the precast elements at an angle to the joint.

Preferably, the system includes a first fastener and a second fastener, wherein the first part and the second part receive the first and second fasteners such that each of the fasteners secures the second concrete element relative to the first concrete element with the fasteners mutually crossed at a location in a gap between the concrete elements.

In a preferred form, one of the fasteners is spaced above the other fastener.

Preferably, a distal end of one fastener is coupled relative to reinforcing in one concrete element and a distal end of the other fastener is coupled relative to reinforcing in the other concrete element.

Preferably, each part has a forward sleeve for receiving one fastener and a rearward aperture for receiving the other fastener.

It is preferred that a gap between the first part and the second part is filled with a filler material. More preferably, the filler material surrounds and confines the crossing of the fasteners. Even more preferably, the filler material is in the form of fibre-reinforced grouting. In one form, by filling void volume and by closely surrounding the fasteners in a strong, rigid and/or incompressible body when set, the filler forms a structural shear-resistant connection between the concrete panels. In particular, the filler acts as a dowel, "biscuit" or "key". In this way, the reinforced filler creates capacity to resist shear load.

Preferably, subsequent to tightening of the fasteners, the filler is applied to recesses in each of the concrete panels surrounding the fasteners. The filler may also be used for housing tightening nuts of the fasteners for providing a consistent and flush surface across the concrete elements. In an example, the fasteners may be in the form of M24 8.8 industrial fasteners.

In a preferred form, the grouting is reinforced with polyester fibres.

Preferably, each fastener crosses between the concrete elements, a distal end of the first fastener being coupled relative to reinforcement of one concrete element and a distal end of the second fastener being coupled relative to reinforcement in the other concrete element.

Preferably, the fasteners are arranged to form an obtuse angle there-between facing an opening of a gap between the concrete elements.

The fasteners may be arranged to form an acute angle there-between facing the opposed edges of the concrete elements.

Preferably, each of the fasteners is threaded to facilitate tightening of the securement of one concrete element relative to the other concrete element.

In a preferred form, each of the fasteners is elongated.

Each of the fasteners may be arranged to be accessible from a front cavity formed in the respective concrete element for tightening of the fastener.

In accordance with another aspect of the present invention, there is provided a connection system for concrete elements in combination with a pair of concrete elements, wherein the system includes a first part cast into a first one of the concrete elements and a second part cast into a second one of the concrete elements, wherein the first part and the second part define cavities in the respective concrete elements, and wherein the cavities are filled with reinforced grouting to form a shear-resistant body between the concrete elements to secure each concrete element relative to the other concrete element.

In accordance with yet another aspect of the present invention, there is provided a method of coupling a pair of precast concrete elements including the steps of:

providing a connection system including a first part, a second part, a first fastener and a second fastener;

casting the first part into a first one of the concrete elements;

casting the second part into a second one of the concrete elements;

arranging the first part and the second part to receive the first and second fasteners such that each of the fasteners couples the second concrete element relative to the first concrete element with the first and second fasteners crossing a joint between the precast elements at an angle to the joint; and tightening the first and second fasteners to secure the second concrete element relative to the first concrete element.

Preferably, the method further includes the step of filling a gap between the concrete elements with a filler material to form a shear-resistant body between the concrete elements.

In accordance with another aspect of the present invention, there is provided a part for connecting precast elements, wherein the part is adapted for being cast into a precast element, the part including an angled receiving thread and an angled spacer tube.

Preferably, the part includes a body, with the angled receiving thread and the angled spacer tube each being mounted on the body. More preferably, the body is in the form of a plate.

In a preferred form, the angled receiving thread and the angled spacer tube are each angled at a common angle relative to an axis normal to a plane of the body. More preferably, an angle between the angled receiving thread and the angled spacer tube is bisected by the axis normal to the plane of the body.

BRIEF DESCRIPTION OF THE DRAWINGS

A preferred embodiment of the invention will be described, by way of non-limiting example only, with reference to the accompanying drawings in which.

DETAILED DESCRIPTION

With reference to FIGS. 1 to 7, there is shown a method and apparatus for coupling precast elements and, in particular for coupling precast concrete panels, according to a preferred embodiment of the present invention. There is also shown a part for connecting precast elements, wherein the part is adapted for being cast into a precast element, the part including an angled receiving thread and an angled spacer. The spacer nay be in the form of a spacer tube.

Figure 1:
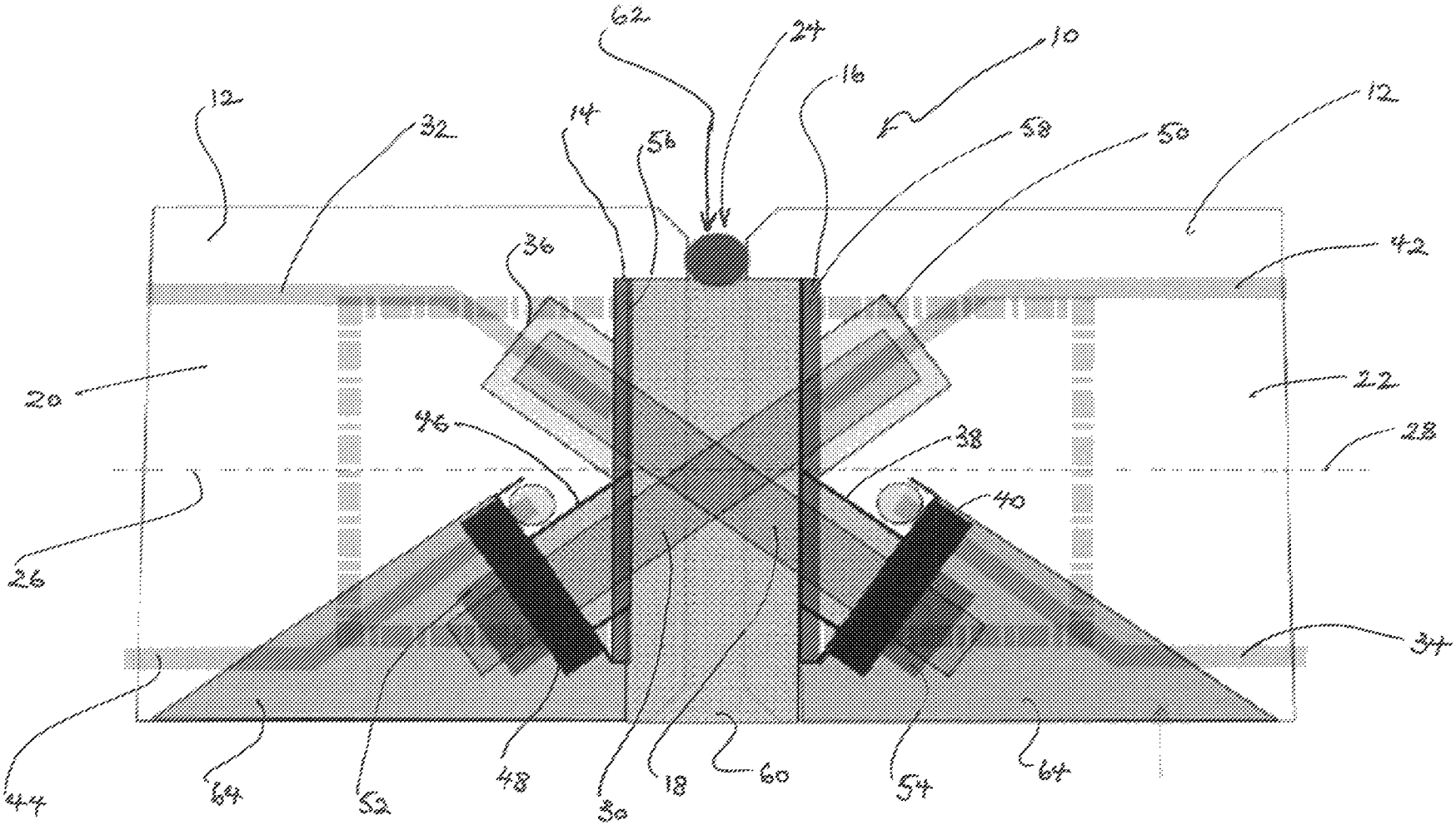
FIG. 1 shows an example of the present invention as depicted in connecting a pair of concrete elements (depicted in the form of concrete panels) in edge-to-edge arrangement.

More specifically, FIG. 1 shows an apparatus 10 for connecting precast elements 12, wherein the apparatus 10 includes a first part 14 adapted for being cast into a first one of the precast elements 12, and the apparatus 10 further includes a second part 16 adapted for being cast into a second one of the precast elements 12. The first part 14 and the second part 16 are arranged to receive a fastener 18 for fastening the second precast element 22 relative to the first precast element 20 wherein the fastener 18 crosses a joint 24 between the precast elements 20, 22 at an angle to the joint 24.

A longitudinal axis of the fastener 18 is located at a non-zero angle to a first normal axis 26 normal to a joint edge surface of the first precast element 20 and is also at a non-zero angle to a second normal axis 28 normal to a joint edge surface of the second precast element 22. In the example shown in FIG. 1, the first normal axis 26 and the second normal axis 28 may in fact be inline.

More specifically, in the example shown in FIG. 1, the first part 14 and the second part 16 are arranged to receive a pair of fasteners 18, 30 for fastening the second precast element 22 relative to the first precast element 20. In the example shown, each of the fasteners 18, 30 crosses the joint 24 between the precast elements 20, 22 at an angle to the joint 24.

The fasteners 18, 30 may be spaced in a dimension parallel to a longitudinal axis of the joint 24—in the example shown in FIG. 1, the longitudinal axis of the joint 24 runs into the page (ie. normal to the surface of the page). The image shown in FIG. 1 may be a plan view and, in that event, the fasteners 18, 30 may be spaced in a vertical dimension. The applicant has identified that it is beneficial to have the fasteners 18, 30 at a certain spacing apart. There is an optimised spacing range so as to maximise strength, as the applicant has identified that being too close or too far between the bolts will be weaker than an optimum range. In particular, the applicant has identified that a good vertical offset between the fasteners may be approximately 300 mm.

The fasteners 18, 30 may be crossed in at least one dimension. For example, in the drawing shown in FIG. 1, the fasteners 18, 30 are crossed so as to form a visual "X" when viewed from above. In another example, the fasteners 18, 30 may be crossed in two mutually perpendicular dimensions. This may be achieved by crossing the fasteners 18, 30 in a horizontal direction and in a vertical direction such that the fasteners 18, 30 are crossed to form a visual "X" when viewed from above and also when viewed from a side. In this way, it can be said that the fasteners 18, 30 are mutually crossed.

The fastener 18 (or fasteners 18, 30) may provide a direct connection between reinforcement 32 in the first element 20 and reinforcement 34 in the second element 22. More specifically, the fastener 18 may provide a direct connection between rear reinforcement 32 in the first element 20 and front reinforcement 34 in the second element 22. This may be achieved by having the front reinforcement 34 coupled directly to a spacer tube 38 or washer 40 of the second part 16 and by having the rear reinforcement 32 coupled directly to a receiving thread 36 of the first part 14. In the embodiment shown in FIG. 1, one fastener 18 provides a direct connection between rear reinforcement 32 in the first element 20 and front reinforcement 34 in the second element 22, and the other fastener 30 provides a direct connection between rear reinforcement 42 in the second element 22 and front reinforcement 44 in the first element 20. Similarly, this may be achieved by having the front reinforcement 44 coupled directly to a spacer tube 46 or washer 48 of the first part 14 and by having the rear reinforcement 42 coupled directly to a receiving thread 50 of the second part 16. This interconnection of the reinforcement in the first element and the second element results in structural robustness, improved capacity and a monolithic-type structure.

The fasteners 18, 30 in the arrangement made by the applicant provide a significant advantage by connecting reinforcing on one face of the block/wall to the reinforcing of another face (ie. front to back) of the block/wall. Advantageously, there are significant benefits through having a crossed bolt/fastener arrangement with vertical spacing between the bolts/fasteners, including:

- structural robustness in the sense that it structurally becomes like a monolithic construction;
- stronger intention; and
- providing the ability to support horizontal and vertical shear.

The fasteners 18, 30 may each be provided with a driving part 52, 54, such as in the form of a driving head which is able to be driven by a suitable driving tool such as a spanner or wrench for tightening the connection. Each of the fasteners 18, 30 may be provided at a distal end with a tapered guiding portion (for example, in a cone or frusto-conical shape) to assist with insertion and driving of the respective fastener relative to the respective receiving thread 36, 50.

In one form, each fastener 18, 30 extends in a respective plane, each of the respective planes being within plus or minus 10° of a horizontal plane. In other words, with regard to the example shown in FIG. 1, the fastener 18 may extend in a first horizontal plane and the fastener 30 may extend in a second horizontal plane, the second horizontal plane being vertically spaced from the first horizontal plane.

The first part 14 and the second part 16 may be arranged such that the fasteners are in a mutually crossed configuration. This may be achieved by forming the first part 14 and second part 16 as a common identical part, and by arranging the second part to be rotated 180° about a vertical axis and 180° about a horizontal axis relative to the first part, as is depicted in FIG. 1.

Each part 14, 16 may be adapted to be anchored relative to each of the first fastener 18 and the second fastener 30, directly and/or by way of reinforcement of the precast elements. The first part 14 may be in the form of a first plate 56 arranged for casting into an opposed edge of the first precast element 20 and the second part 16 may be in the form of a second plate 58 arranged for casting into an opposed edge of the second precast element 22. As can be seen in FIG. 1, the first plate 56 has a spacer tube 46 (or sleeve) for receiving one of the fasteners, and the second plate 58 has a spacer tube 38 (or sleeve) for receiving the other fastener. As mentioned above, both parts 14, 16 may be the same in that they may be formed as identical common parts. Advantageously, as both parts 14, 16 may be the same, they may be used interchangeably.

The plates 56, 58 may be adapted to be arranged in a mutually parallel facing configuration, each of the spacer tubes 38, 50 extending outwardly from the respective plate 56, 58 at an angle so as to open toward an exposed side of the first and second precast elements 20, 22. More preferably, each of the spacer tubes 38, 50 may be arranged to open into a cavity formed in the respective precast element. Each of the spacer tubes 38, 50 may have an outward bearing surface for bearing relative to the respective washer 40, 48 and driving part 52, 54 (or nut) as the driving part 52, 54 is tightened on the fastener 18, 30 extending through the spacer tube 38, 50. Once the precast elements 20, 22 are connected in this way, filler material 60 is applied between the elements 20, 22. The filler material 60 surrounds the fasteners 18, 30 and acts as a structural shear connection between the concrete elements 20, 22. In this way, the filler material 60 acts as a dowel so as to further secure the connection. The filler material 60 may be in the form of grout filler with non-shrink high-strength fibre reinforcement. A seal 62 may also be provided along a rear location of a gap between the elements 20, 22 for sealing between the elements 20, 22 and to prevent unwanted egress of the filler material 60. Recesses 64 formed at a frontal exposed surface of the elements 20, 22 may also be filled with non-shrink grout to achieve fire rating requirements.

Another aspect of the invention provides a system for connecting precast elements 20, 22. The system includes the first part 14 adapted for being cast into a first one 20 of the precast elements and a second part 16 adapted for being cast into a second one 22 of the precast elements. The system further includes the fastener 18, wherein the first part 14 and the second part 16 are arranged to receive the fastener 18 for fastening the second precast element 22 relative to the first precast element 20 with the fastener 18 crossing a joint 24 between the precast elements 20, 22 at an angle to the joint 24.

In yet another aspect, there is provided a connection system for concrete elements 20, 22 in combination with a pair of concrete elements 20, 22. The system includes the first part 14 cast into the first concrete element 20 and the second part 16 cast into the second concrete element 22. The system further includes at least one fastener 18. The first part 14 and the second part 16 receive the fastener 18 such that the fastener 18 secures the second concrete element 22 relative to the first concrete element 20 with the fastener 18 crossing the joint 24 between the precast elements 20, 22 at an angle to the joint 24.

The system may include the first fastener 18 and a second fastener 30, whereby the first part 14 and the second part 16 each receive the first and second fasteners 18, 30 such that each of the fasteners 18, 30 secures the second concrete element 22 relative to the first concrete element 20 with the fasteners 18, 30 mutually crossed at a location in a gap between the concrete elements 20, 22. One of the fasteners 18 may be spaced above the other fastener 30.

A distal end of one fastener 18 may be coupled relative to reinforcing in one concrete element and a distal end of the other fastener 30 may be coupled relative to reinforcing in the other concrete element. Each of the parts 14, 16 may be provided with a forward spacer tube for receiving one fastener and a rearward receiving thread (or aperture) for receiving the other fastener.

In one example, a gap between the first part 14 and the second part 16 is filled with the filler material 60. The filler material 60 may surround and confine the crossing of the fasteners 18, 30. The filler material 30 may be in the form of fibre-reinforced grouting. In one form, by filling void volume and by closely surrounding the fasteners 18, 30 in a strong, rigid and/or incompressible body when set, the filler material 60 forms a structural shear-resistant connection between the concrete elements/panels 20, 22. In particular, the filler material 60 may act as a dowel, "biscuit" or "key". In this way, the reinforced filler creates capacity to resist shear load.

Subsequent to tightening of the fasteners 18, 30, the filler material 60 may be applied to recesses 64 in each of the concrete panels surrounding the fasteners 18, 30. The filler material 60 may also be used for housing tightening nuts of the fasteners for providing a consistent and flush surface across the concrete elements 20, 22. In an example, the fasteners 18, 30 may be in the form of M24 8.8 industrial fasteners. The filler material 60 may be in the form of grouting, reinforced with polyester fibres.

As will be appreciated, each of the fasteners 18, 30 crosses between the concrete elements 20, 22, a distal end of the first fastener being coupled relative to reinforcement of one concrete element and a distal end of the second fastener being coupled relative to reinforcement in the other concrete element. As can be seen in FIG. 1, the fasteners 18, 30 are arranged to form an obtuse angle there-between facing an opening of a gap between the concrete elements 20, 22. Consequently, also with reference to FIG. 1, the fasteners 18, 30 may be arranged to form an acute angle there-between facing the opposed edges of the concrete elements 20, 22.

Each of the fasteners 18, 30 is threaded to facilitate tightening of the securement of one concrete element 22 relative to the other concrete element 20. More specifically, each of the fasteners 18, 30 has a male thread which mates with the female thread of the corresponding receiving thread 36, 50. Each of the fasteners 18, 30 may be elongated, as depicted.

Each of the fasteners 18, 30 may be arranged to be accessible from a front cavity formed in the respective concrete element 22, 20 for tightening of the fastener 18, 30 by way of the driving head 54, 52.

In another aspect, there is provided a connection system for concrete elements 20, 22 in combination with a pair of concrete elements 20, 22. The system includes a first part 14 cast into the first concrete element 20 and a second part 16 cast into the second concrete element 22. The first part 14 and the second part 16 define cavities in the respective concrete elements 20, 22. The cavities are filled with reinforced grouting to form a shear-resistant body between the concrete elements 20, 22 to secure each concrete element 20, 22 relative to the other concrete element 22, 20.

Yet another aspect provides a method of coupling a pair of precast concrete elements 20, 22 including the steps of: providing a connection system including a first part 14, a second part 16, a first fastener 18 and a second fastener 30; casting the first part 14 into the first concrete element 20; casting the second part 16 into the second concrete element 22; arranging the first part 14 and the second part 16 to receive the first and second fasteners 18, 30 such that each of the fasteners 18, 30 couples the second concrete element 22 relative to the first concrete element 20 with the first and second fasteners 18, 30 crossing a joint 24 between the precast elements 20, 22 at an angle to the joint 24; and tightening the first and second fasteners 18, 30 to secure the second concrete element 22 relative to the first concrete element 20.

The method may also include the step of filling a gap between the concrete elements 20, 22 with a filler material 60 to form a shear-resistant body between the concrete elements 20, 22. Advantageously, the fasteners and the grout provide reinforcement to each other in a manner similar to a composite strengthening with matrix and fibre phases.

Another aspect of the invention provides a part 14 for connecting precast elements 20, 22, wherein the part 14, 16 is adapted for being cast into a precast element 20, 22, the part 14, 16 including an angled receiving thread 36, 50 and an angled spacer 46, 38. The angled spacer may be in the form of an angled spacer tube 46, 38.

The part 14, 16 may include a body (corresponding to the first plate 56 or the second plate 58), with the angled receiving thread 36, 50 and the angled spacer tube 46, 38 each being mounted on the body 56, 58. Although in the example depicted the body is in the form of a plate, it will be appreciated by those skilled in the art that the body may take other forms in different examples. Accordingly, each of the parts 14, 16 is provided with angles in the plate/body for both fastening mechanisms between the concrete elements.

The angled receiving thread 36, 50 and the angled spacer tube 46, 38 may each be angled at a common angle relative to an axis normal to a plane of the body. More specifically, an angle between the angled receiving thread 36, 50 and the angled spacer tube 46, 38 may be bisected by the axis normal to the plane of the body. The fasteners may be angled so as to form an angle of between 25° and 60° between the fasteners in the directions facing inwardly toward the precast elements.

Further details about dimensions will be evident from the remaining drawings and it is to be appreciated that the angle of the fasteners/bolts may be critical. In practical applications, it may be necessary to have tolerances of, for example, 10 mm to 20 mm in order to function, particularly bearing in mind the environment in which these products may be used. The gap between the plates may be nominally 20 mm, +/−15 mm. Other tolerances may come from Australian standards such as vertical spacing with a tolerance of +/−20 mm and horizontal spacing with a tolerance of +/−10 mm.

Figure 2:
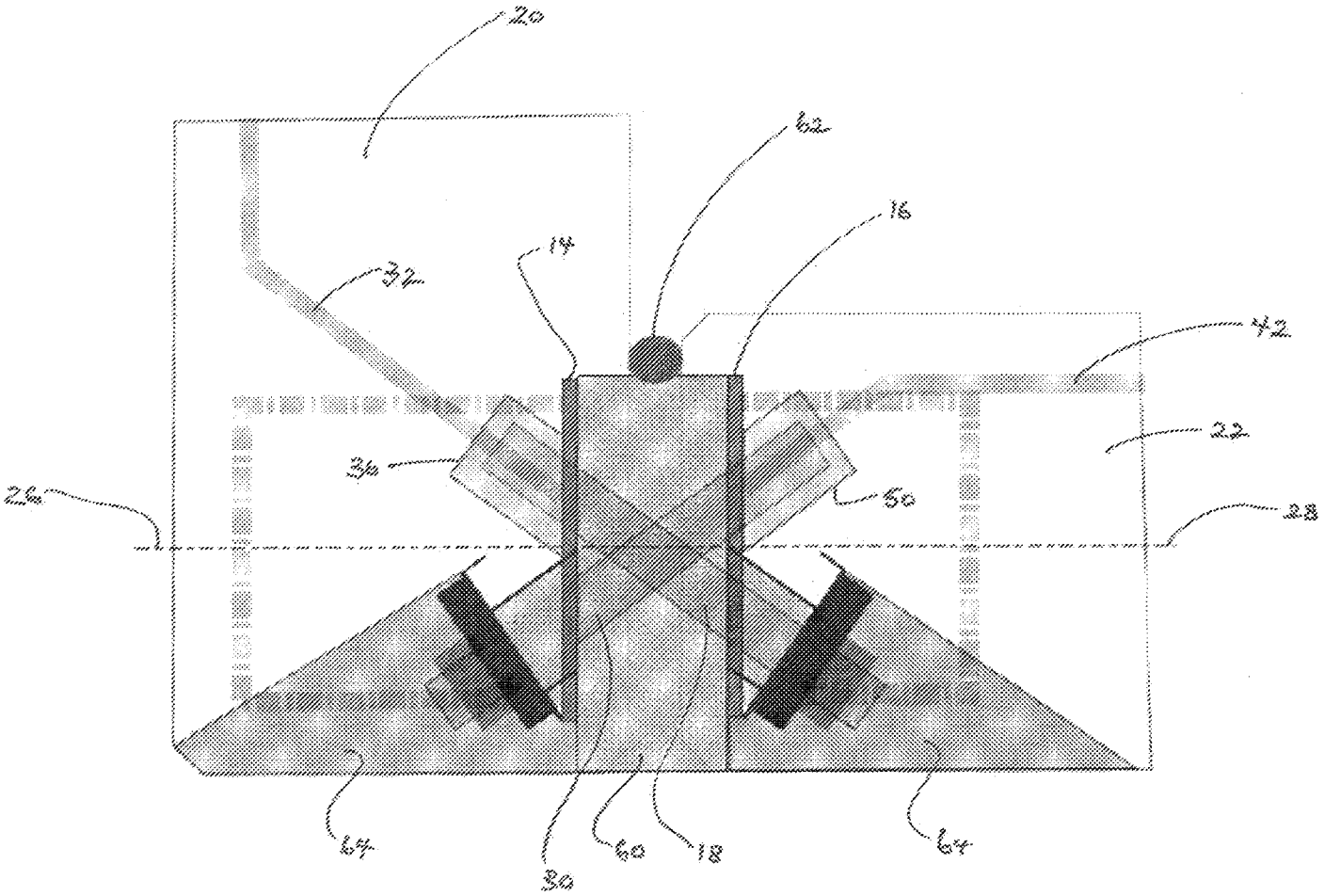
FIG. 2 shows another example of the present invention as depicted in connecting a pair of concrete panels in edge-to-face arrangement (corner joint)

With reference to FIGS. 2 to 7, there are shown other examples of the present invention in practice and like reference numerals are used. In particular, FIG. 2 shows another example of the present invention as connecting a pair of concrete panels in edge-to-face arrangement for a corner joint.

Figure 3:
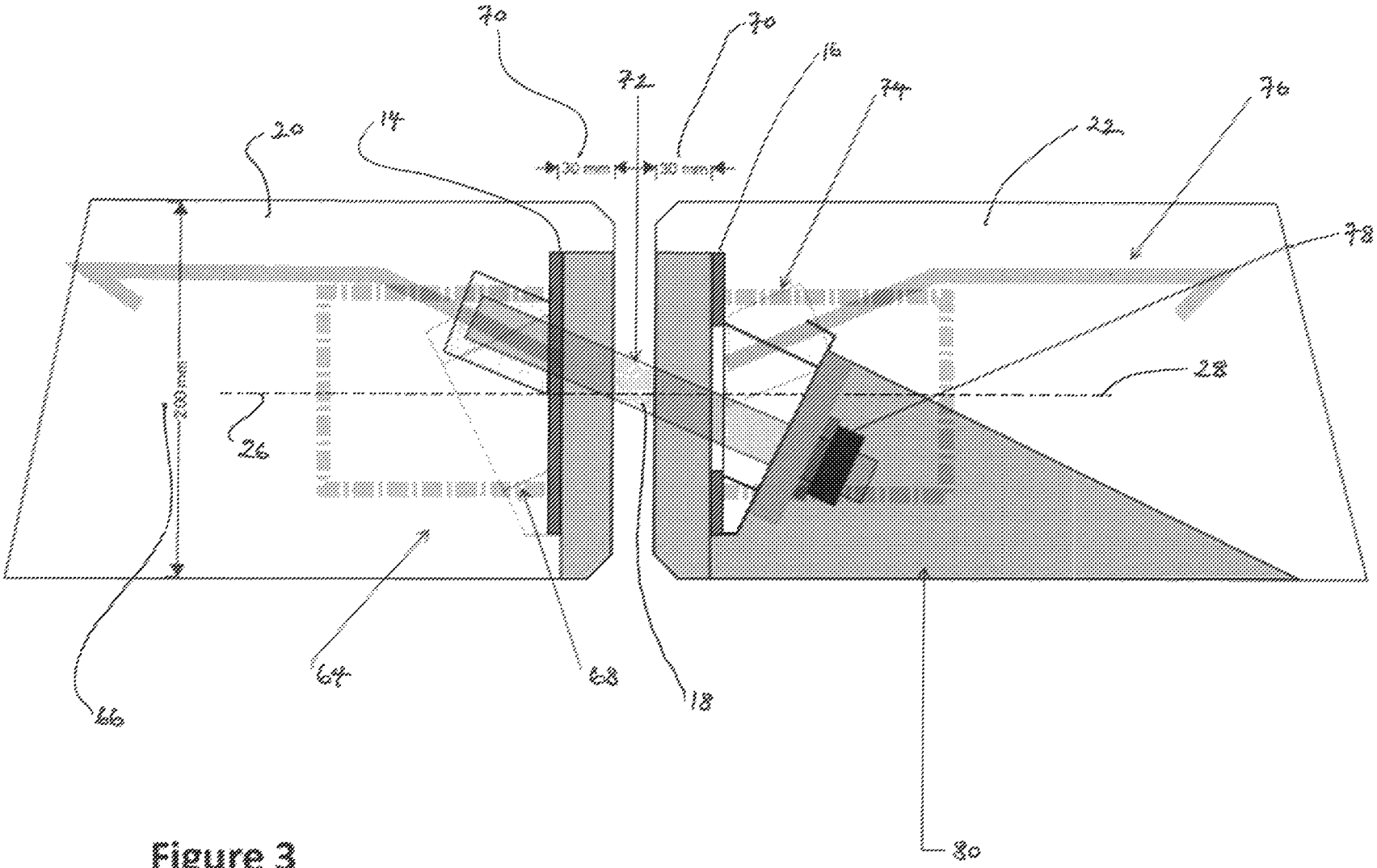
FIG. 3 shows a detailed plan view of a precast shear connector (half joint shown only) installed into precast panels.

FIG. 3 shows a detailed plan view of a precast shear connector (half joint shown only) installed into precast panels. As shown at reference 64, U bar reinforcement may be provided. The U bars 64 may be in the form of 3/N 16 U bars FSBW attached to the first plate 56 which itself may be in the form of a 10 mm plate having a width of 150 mm and a depth of 250 mm. In the particular example shown, the precast component 20 may have a depth of 200 mm, as depicted at reference numeral 66. At reference numeral 68, there may be provided an square hollow section (SHS), being a steel tube with a square cross section, angle cut with folded plate over. Dimensions at reference numeral 70 may be 30 mm.

Figure 4:
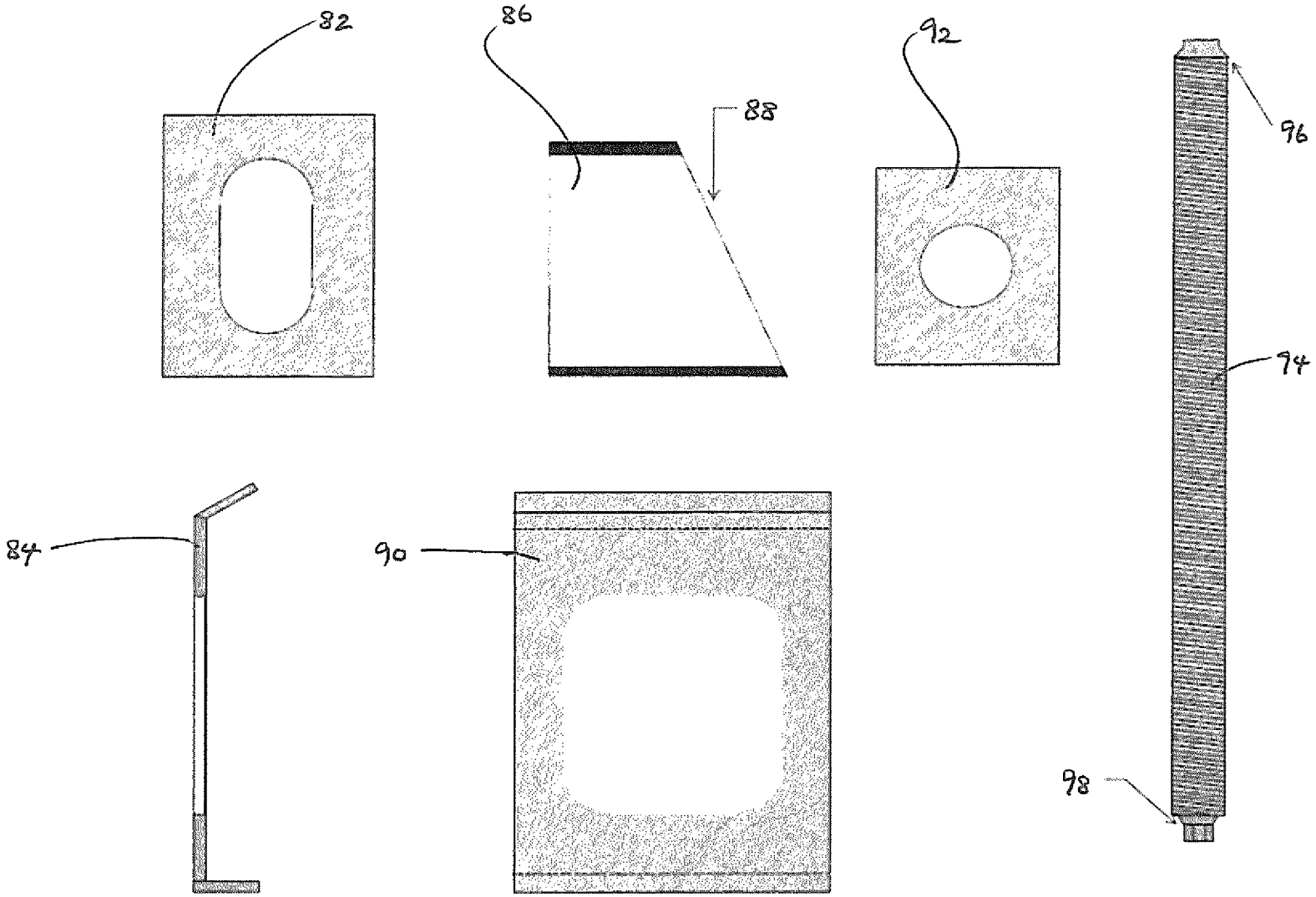
FIG. 4 shows separated elements of a connection system according to an example of the present invention.

With reference to FIG. 4, there are shown an elongated shaped washer (not to scale) 82, a 6 mm folded plate 84, SHS (not to scale) 86 of which side 88 is welded to the cast in plate, a plan view 90 of the plate shown at 84, a 5 mm plate washer (not to scale) 92, and a grade 8.8 threaded rod 94. At reference numeral 96, there is provided a taper 10 mm of end of rod to 10 mm diameter, and at reference numeral 98 there is a 16 mm hex driving head.

Figure 5:
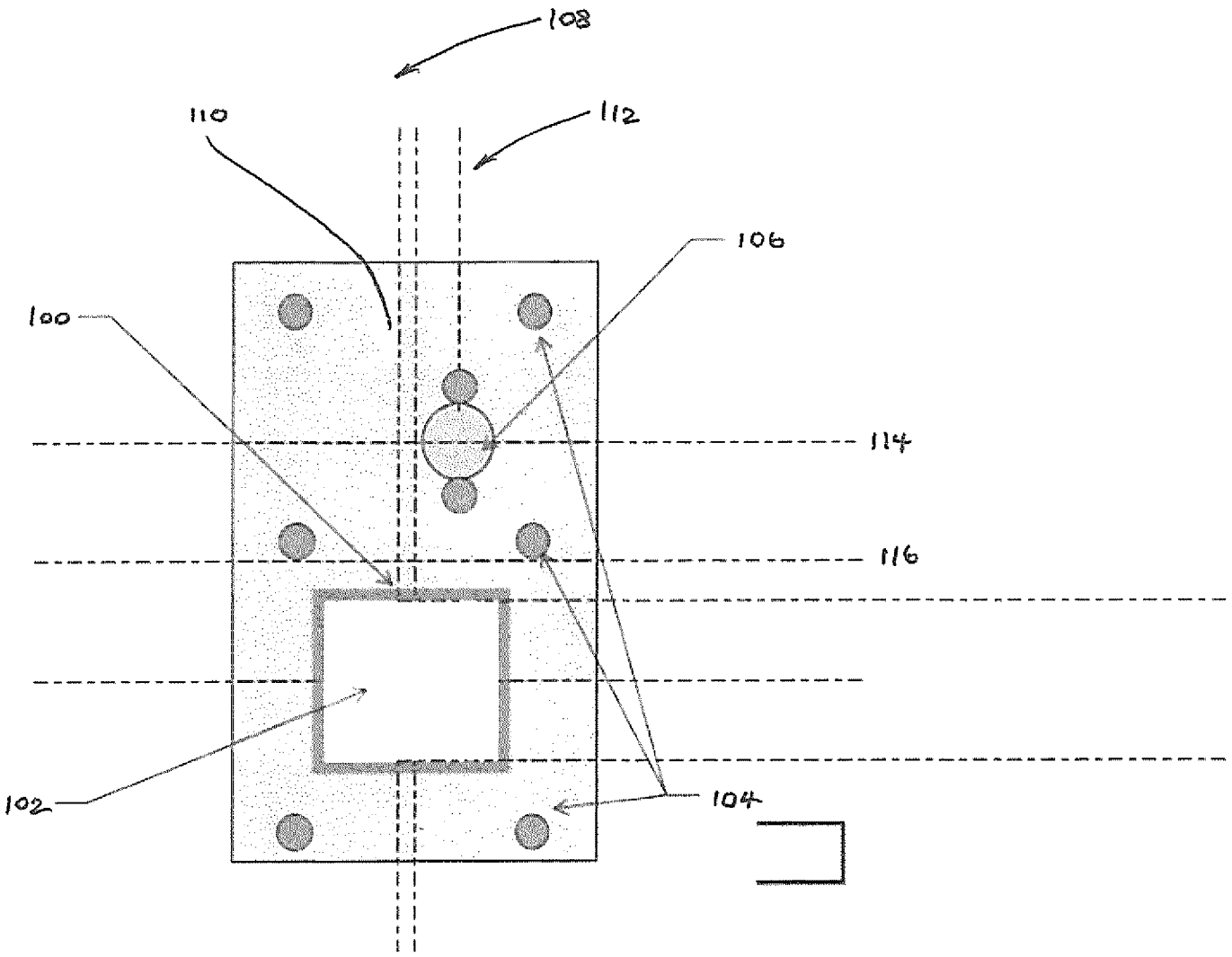
FIG. 5 shows detail of an inside face of a shear connector of the connection system.

Turning to FIG. 5, there is shown an inside face of the shear connector. The numbered features of the shear connector as shown in FIG. 5 are explained under the list of features by reference numerals, as follows.

Figure 6:
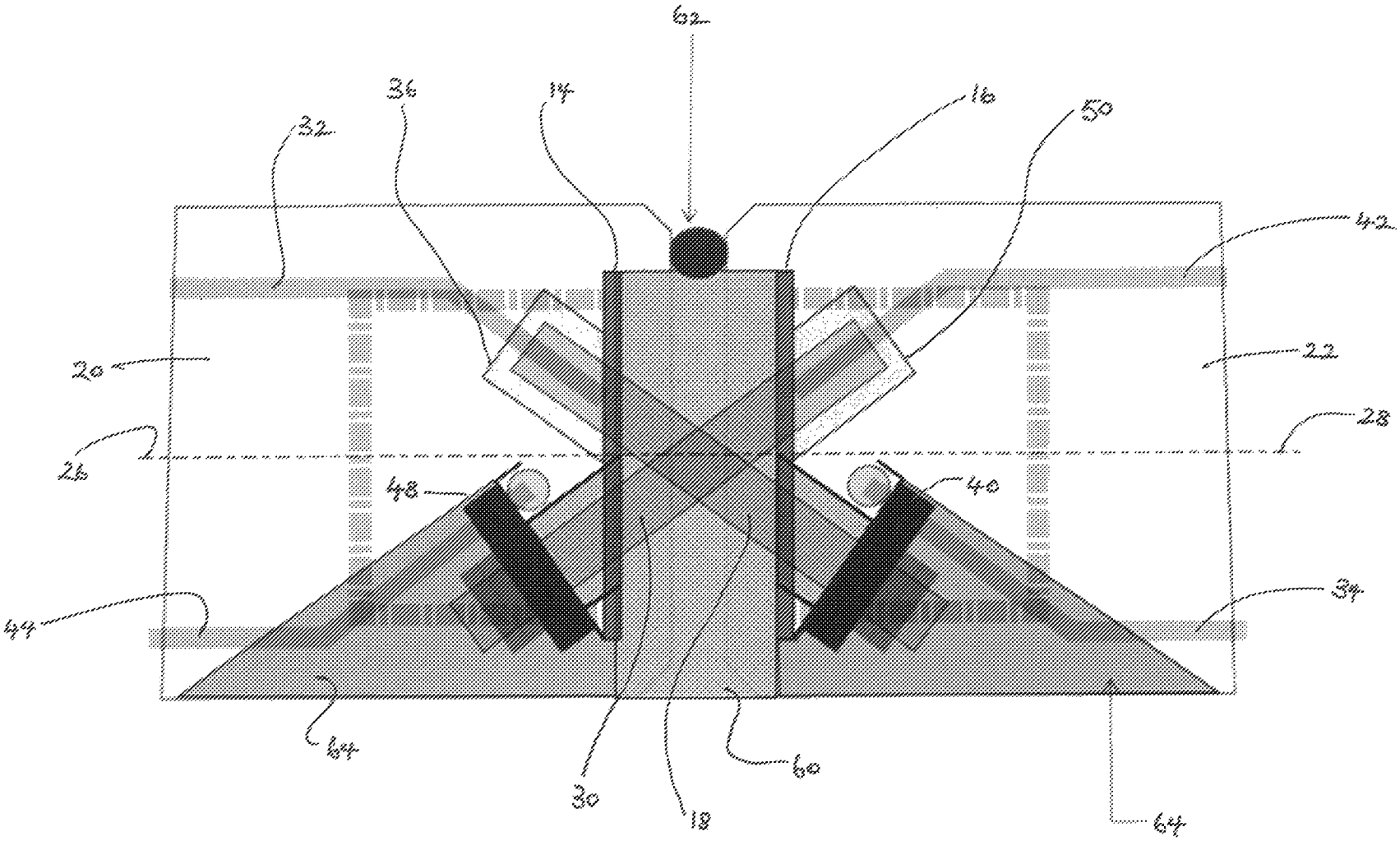
FIG. 6 shows a plan view of a final installed condition of a shear connector.
Figure 7:
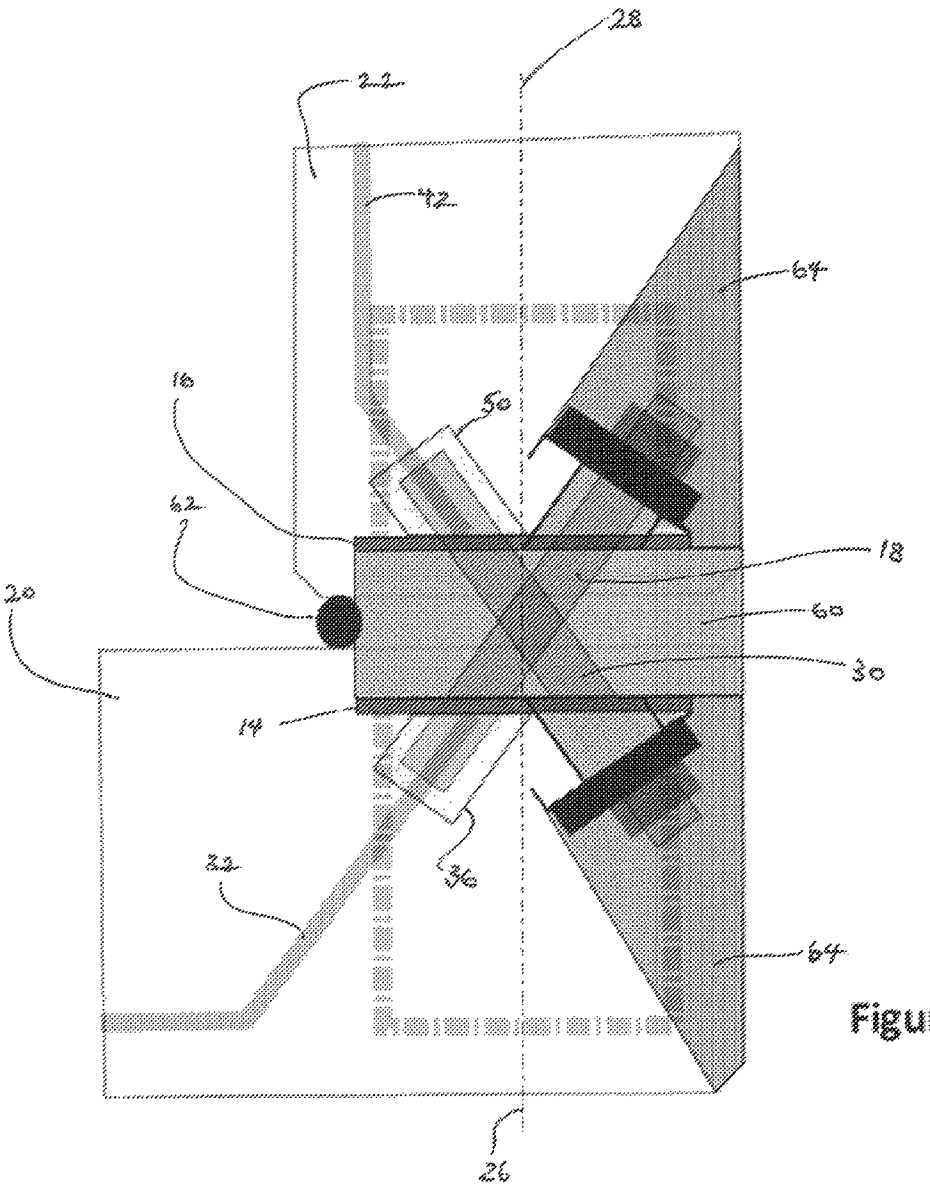
FIG. 7 shows a final installed condition of a shear connector in a corner joint.

FIG. 6 shows a plan view of a final installed condition of a shear connector, and FIG. 7 shows a final installed condition of a shear connector in a corner joint. Like features have been labelled with like reference numerals in comparison to the previous drawings. With particular reference to FIG. 6, there is provided a seal 62 between the elements/panels 20, 22. The gap is grout filled with non-shrink high strength fibre reinforced grout. At reference numeral 64, the void is filled with non-shrink grout to achieve fire ratings as well as to provide a clean, flush appearance.

Example—New Vertical Wall Connection

Utilising steel Cast in Connector in two elements and bolting diagonally across panel joint.

Medium—High shear capacity availability using this method.

Shear capacity across a vertical panel joint can be increased by utilising more connections, ie connectors cast in every 1 m or increase in bolt size Cost to cast into precast panel during manufacture reasonable Requires Precast manufacturer to cast in connector into panels Standard sizing Onsite requires un-skilled labour to bolt together Onsite requires labour to patch/mortar fill recessed pocket Fire rating requirement Aesthetics Structural advantage in cross bolting to connect both faces or reinforcement in panels Panel joint filled with fibre reinforced grout or similar material contributing to overall performance Easy system to temporarily connect panels as bolting Fast panel installation Limited labour on site Limited OHS onsite—no welding While various embodiments of the present invention have been described above, it should be understood that they have been presented by way of example only, and not by way of limitation. It will be apparent to a person skilled in the relevant art that various changes in form and detail can be made therein without departing from the spirit and scope of the invention. Thus, the present invention should not be limited by any of the above described exemplary embodiments.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

LIST OF FEATURES BY REFERENCE NUMERAL

10 apparatus for connecting precast elements
12 precast elements
14 first part
16 second part
18 fastener
20 first precast element
22 second precast element
24 joint
26 first normal axis
28 second normal axis
30 second fastener
32 rear reinforcement (first part)
34 front reinforcement (second part)
36 receiving thread (first part)
38 spacer tube (second part)
40 washer (second part)
42 rear reinforcement (second part)

44 front reinforcement (first part)
46 spacer tube (first part)
48 washer (first part)
50 receiving thread (second part)
52 driving part (first fastener)
54 driving part (second fastener)
56 first plate
58 second plate
60 filler material
62 seal
64 U bar
66 thickness dimension of 200 mm (example only)
68 square hollow section (SHS), being a steel tube with a square cross section, angle cut with folded plate over
70 Dimension of 30 mm (example only)
72 2 grade 8.8 bolts (one bolt not shown for clarity)
74 fabricated ferrule to suit—angle to suit bolt—fully weld to plate— N bars lug welded top and bottom
76 135 degree COG at end
78 washer with elongated hole—additional 5 mm plate (60 mm square) washer over
80 void former to be removed on site and filled with non-shrink grout post installation of bolt
82 elongated shaped washer (not to scale)
84 6 mm folded plate—weld to top of the right-hand side
86 SHS
88 side of SHS to be welded to the cast in plate
90 plate plan view
92 5 mm plate washer (not to scale)
94 grade 8.8 threaded rod
96 taper 10 mm of end of rod to 10 mm diameter
98 provide 16 mm hex driving head
100 splayed SHS welded to back of plate
102 6 oversized void with radius corners
104 N16 'U' bars FSBW to back of plate
106 ferrule fully welded to back of plate. Angle drill plate or oversize hole to suit bolt and ferrule. Lug weld N bar to plate and ferrule to develope bolt
108 CL. plate
110 CL. void
112 CL. 26 mm diam hole
114 CL. ferrule
116 CL. plate The claims defining the invention are as follows:

1. An apparatus for connecting precast elements, the precast elements including reinforcements, wherein the apparatus includes a first part adapted for being cast into a first one of the precast elements and to couple with a reinforcement of the first precast element, and the apparatus further includes a second part adapted for being cast into a second one of the precast elements and to couple with a reinforcement of the second precast element, the first part and the second part being arranged to receive a pair of fasteners for fastening the second precast element relative to the first precast element, wherein the first part and the second part are configured to align each fastener to cross a joint between the precast elements at an angle to the joint, and wherein one fastener provides a direct connection between a rear reinforcement of the first element and a front reinforcement of the second element, and the other fastener provides a direct connection between a rear reinforcement of the second element and a front reinforcement of the first element.

2. An apparatus as claimed in claim 1, wherein a longitudinal axis of each fastener is located at a non-zero angle to a first normal axis normal to a joint edge surface of the first precast element and is also at a non-zero angle to a second normal axis normal to a joint edge surface of the second precast element.

3. An apparatus as claimed in claim 1, wherein the fasteners are: (i) spaced in a dimension parallel to a longitudinal axis of the joint; and/or (ii) spaced in a vertical dimension and/or (iii) crossed in at least one dimension.

4. An apparatus as claimed in claim 1, wherein the first part is in the form of a first plate arranged for casting into an opposed edge of the first precast element and the second part is in the form of a second plate arranged for casting into an opposed edge of the second precast element.

5. An apparatus as claimed in claim 4, wherein the first plate has a sleeve for receiving a first one of the fasteners, and the second plate has a sleeve for receiving a second one of the fasteners.

6. An apparatus as claimed in claim 5, wherein the plates are adapted to be arranged in a mutually parallel facing configuration, each of the sleeves extending outwardly from the respective plate at an angle so as to open toward an exposed side of the first and second precast elements.

7. An apparatus as claimed in claim 6, wherein each of the sleeves is arranged to open into a cavity formed in the respective precast element.

8. An apparatus as claimed in claim 7, wherein one or more of the sleeves has an outward bearing surface for bearing relative to a nut as the nut is tightened on the fastener extending through the sleeve.

9. A combination comprising a pair of concrete elements that are coupled together by the apparatus of claim 1, wherein the first part that is cast into a first one of the concrete elements and the second part that is cast into a second one of the concrete elements, wherein the first part and the second part receive the pair of fasteners such that the pair of fasteners secures the second concrete element relative to the first concrete element with each fastener crossing a joint between the precast elements at an angle to the joint.

10. A combination as claimed in claim 9, wherein the first part and the second part receive the first and second fasteners such that each of the fasteners secures the second concrete element relative to the first concrete element with the fasteners mutually crossed at a location in a gap between the concrete elements.

11. A combination as claimed in claim 10, wherein one of the fasteners is spaced above the other fastener.

12. A combination as claimed in claim 10, wherein a distal end of one fastener is coupled relative to the reinforcement of one concrete element and a distal end of the other fastener is coupled relative to the reinforcement of the other concrete element.

13. A combination as claimed in claim 10, wherein each part has a forward sleeve for receiving one fastener and a rearward aperture for receiving the other fastener.

14. A combination as claimed in claim 9, wherein a gap between the first part and the second part is filled with a filler material, wherein the filler forms a shear-resistant body between the concrete elements.

* * * * *